United States Patent [19]

Ikejima

[11] Patent Number: 4,815,567

[45] Date of Patent: Mar. 28, 1989

[54] APPARATUS FOR CONTROLLING AN A.C. POWERED ELEVATOR

[75] Inventor: Hiroyuki Ikejima, Inazawa, Japan

[73] Assignee: Mitsubishi Denki Kabushiki Kaisha, Japan

[21] Appl. No.: 195,301

[22] Filed: May 18, 1988

[30] Foreign Application Priority Data

May 20, 1987 [JP] Japan ..... 62-123401

[51] Int. Cl.[4] ..... B66B 1/30

[52] U.S. Cl. ..... 187/119; 318/807

[58] Field of Search ..... 187/119; 318/757–759, 318/807

[56] References Cited

U.S. PATENT DOCUMENTS 4,366,427 12/1982 Walker et al. ..... 318/807 X
4,548,299 10/1985 Nomura ..... 187/119 X
4,625,159 11/1986 Ikejima ..... 318/807 X
4,748,394 5/1988 Watanabe ..... 318/807

FOREIGN PATENT DOCUMENTS 61-224888 10/1986 Japan .

*Primary Examiner*—William M. Shoop, Jr.
*Assistant Examiner*—W. E. Duncanson, Jr.
*Attorney, Agent, or Firm*—Leydig, Voit & Mayer

[57] ABSTRACT

An apparatus for controlling an A.C. powered elevator is provided to reduce a primary current frequency to an induction motor to be smaller than a specific value when the motor is switched from a power drive to a brake mode of operation. In other words, the frequency after the motor is switched to the brake mode is reduced to be lower than the frequency at which the machine input power to the induction motor is equal to the internal power consumption of the induction motor.

2 Claims, 3 Drawing Sheets

APPARATUS FOR CONTROLLING AN A.C. POWERED ELEVATOR

BACKGROUND OF THE INVENTION

The present invention relates to an apparatus for controlling an A.C. powered elevator.

In an A.C. elevator, an induction motor is used as an electric motor for driving an elevator cage, and the output of a variable frequency power source is supplied to the induction motor to vary a slip frequency, thereby controlling the torque of the motor. A process is proposed, according to the invention, for controlling the frequency and the current of a power source for so applying power to an induction motor that no regenerative power is generated in the induction motor at the time of braking the induction motor in the operating of an A.C. powered elevator.

FIGS. 4 and 5 are a circuit diagrams showing a conventional apparatus for controlling an A.C. powered elevator and a simple equivalent circuit diagram of an induction motor for explaining the process for preventing the regenerative power, disclosed in Japanese Patent Laid-open No. Sho 61-224888. In FIG. 5, symbols $l_1$, $l_2$ designate leakage inductances at primary and secondary sides, symbols $R_1$, $R_2$ denote primary and secondary side resistors, symbol S is a slip, and symbols V, I are a voltage applied to the induction motor and a current flowing through the induction motor.

Here, when the slip S is as represented by the following equation (1), $$S = -R_2/R_1 \tag{1}$$

its mechanical input power Pm becomes as represented by the following equation (2), $$Pm = m\frac{1-S}{S}R_2|^2 = -m(R_1 + R_2)\,|^2$$

where m is the number of phases. Since the power $P_E$ consumed in the induction motor is as represented by the following equation (3), $$P_E = m(R_1 + R_2)\,I^2 \tag{3}$$

the mechanical input power becomes equal to the consumed power in the induction motor. Therefore, when the induction motor is driven in the slipping state to satisfy the equation (1), no regenerative power is generated from the induction motor, and it is not necessary to supply power to the induction motor.

On the other hand, the torque T generated from the induction motor becomes as represented by the following equation (4).

$$\omega_r = \frac{1-S}{p}\,\omega_o \tag{5}$$

where $\omega_r$ the rotating angular velocity of the rotor, $\omega_o$ is the input frequency, and p is the number of poles of the induction motor.

However, the rotating angular velocity of the rotor of the induction motor becomes as represented by the following equation (5).

-continued $$T = \frac{Pm}{\omega_r} = \frac{P}{(1-S)\omega_o}\cdot m\frac{1-S}{S}R_2|^2 = mp\frac{R_2}{\omega_o S}\,|^2 \tag{4}$$

When the equation (1) is substituted in the equation (4), the following equation (6) is obtained.

$$T = -mp\frac{R_1}{\omega_o}\,|^2 \tag{6}$$

When the equation (1) is substituted in the equation (5), the following equation (7) is obtained.

$$\omega_o = \frac{P}{1-S}\,\omega_r = P\frac{R_1}{R_1 + R_2}\,\omega_r \tag{7}$$

More specifically, when the input frequency $\omega_o$ is controlled in the state for satisfying the equation (7), no regenerative power is generated from the induction motor, and the torque T at this time is given as represented by the equation (6).

FIG. 4 shows an example exemplified by the abovementioned controlling process. In the drawing, reference numeral 1 designates a subtractor for subtracting the actual speed signal $\omega_r$ output from a tachometer generator 14 to be described later from the speed command signal $\omega_p$, numeral 2 a control compensator for compensating the output signal of the subtractor, and numeral 3 a power drive side current command generator which inputs the torque command signal T output from the control compensator 2 and the actual speed signal $\omega_r$ and outputs a current command value I at the time of power driving operation. Numeral 4 designates a brake side current command generator which inputs the torque command signal T and the actual speed signal $\omega_r$ and outputs a current command value $I_B$ at the time of braking. Numeral 5 designates a switch for selecting the current command value $I_B$ at the time of power drive or the current command value $I_b$ at the time of braking to be switched in response to the polarity of the torque command signal T output from the control compensator 2. Numeral 6 designates a subtractor for subtracting the current value output from a current detector 15 to be described later from the current command value $I_A$ or $I_B$ selected by the switch 5, numeral 7 a pulse-width modulator which inputs the output signal of the subtractor 6 and pulse-width-modulates the output signal, and numeral 8 an inverter controlled by the output of the pulse-width modulator to drive the induction motor 9 as a variable voltage variable frequency power source. Numeral 10 designates a sheave rotatably driven by the induction motor 9, and numeral 13 a wire the ends of which are coupled to a cage 11 and a weight 12, and which is wound on the sheave 10. Numeral 14 designates a tachometer generator for detecting the rotating speed of the induction motor 9, and numeral 15 a current detector for detecting a current flowing to the induction motor 9.

In the apparatus for controlling the A.C. powered elevator constructed as described above, when the torque command signal T output from the control compensator 2 which inputs the output signal of the subtractor 1 for subtracting the actual speed signal $\omega_r$ from the speed command signal $\omega_p$ is positive, i.e., power drive torque is generated, the switch 5 selects the current command value $I_a$ generated from the power drive side current command generator 3 which inputs the torque command signal T and the actual speed signal $\omega_r$. The output signal fed through the switch 5 is subtracted by the subtractor 6 by the output signal of the current detector 15, and the current command necessary to compare it with the actual current is then supplied to the pulse-width modulator 7. The pulse-width modulator 7 controls the inverter 8 in response to the necessary current command, thereby optimally controlling the current supplied from the inverter 8 to the induction motor 9 to thus control the generated torque.

Then, when the control torque that the torque command signal T generated from the control compensator 2 becomes negative, the speed command signal $\omega_o$ is obtained by the equation (7) from the speed signal $\omega_r$. On the other hand, the following current I is obtained by the equation (6) from the torque command torque T.

$$I = K\sqrt{T \cdot \omega_o} \tag{8}$$

Therefore, the brake side current command generator 4 generates the current command value $I_B$ obtained by the equations (7) and (8), which value is supplied through the switch 5 to the subtractor 6. The subtractor 6 supplies the difference between the current command value $I_B$ and the actually measured value supplied from the current detector 15 through the pulse-width modulaor 7 to the inverter 8, which, in turn, controls the current value to be supplied to the induction motor 9 as a target value.

However, when the torque command signal T is shifted from the power drive side to the brake side in the above-mentioned controller, if the input frequency $\omega_o$ of the induction motor 9 is varied to the value designated by the equation (7), the induction motor 9 generates a transient torque ripple, and the ripple frequency becomes equal to the slip frequency $\omega_s$ of the induction motor 9 designated by the following equation (9).

$$\omega_S = \omega_o - P\omega_r \tag{9}$$

When the equation (7) is substituted in the equation (9), the following equation (10) is obtained.

$$\omega_s = -P\frac{R_2}{R_1 + R_2}\omega_r \tag{10}$$

The reason why the equation (1) in which the torque ripple frequency becomes equal to the slip frequency $\omega_s$ is satisfied will be described. The basic equation of the squirrel-cage induction motor is represented as the following equation in the coordinates of orthogonal axis d—lateral axis q fixed to the stator.

$$\begin{bmatrix} v_{ds} \\ v_{qs} \\ 0 \\ 0 \end{bmatrix} = \begin{bmatrix} R_1 + PL_1 & 0 & PM & 0 \\ 0 & R_1 + PL_1 & 0 & PM \\ PM & p\omega_r M & R_2 + PL_2 & p\omega_r L_2 \\ -p\omega_r M & PM & -p\omega_r L_2 & R_2 + PL_2 \end{bmatrix} \begin{bmatrix} i_{ds} \\ i_{qs} \\ i_{dr} \\ i_{qr} \end{bmatrix} \tag{11}$$

where $v_{ds}$: primary d-axis voltage
$v_{qs}$: primary q-axis voltage
$i_{ds}$: primary d-axis voltage
$i_{qs}$: primary q-axis current
$i_{dr}$: secondary d-axis current
$i_{qr}$: secondary q-axis current
$R_1$: primary resistance
$R_2$: secondary resistance
$L_1$: primary self-inductance
$L_2$: secondary self-inductance
M: primary secondary mutual inductance
P: differentiation operator (=d/dt)
P: pole logarithmic number
$\omega_r$: rotating angular velocity of the rotor The generated torque T is represented by the following equation (12).

$$T = p(\phi_{2q} i_{dr} - \phi_{2d} i_{qr}) \tag{12}$$

where $\phi_{2d}$, $\phi_{2q}$ are d-axis and q-axis secondary magnetic fluxes to be represented as below.

$$\phi_{2d} = Mids + L_2 dr \tag{13}$$

$$\phi_{2d} = Miqs + L_2 iqr \tag{14}$$

When the equations (13) and (14) are substituted in the third and fourth lines of the equation (11) and $i_{dr}$ and $i_{qr}$ are erased, the following equations (15) and (16) are obtained as below.

$$(R_2 + PL_2)\phi_{2d} - MR_2 i_{ds} + \omega_2 L_2 \phi_{22q} = 0 \tag{15}$$

$$(R_2 + PL_2)\phi_{2q} - MR_2 i_{qw} \omega_2 L_2 \phi_{2d} = 0 \tag{16}$$

When the equations (13) and (14) are similarly substituted in the equation (12), the following equation (17) is obtained.

$$T = P\frac{M}{L_2}(\phi_{2d} i_{qs} - \phi_{2q} i_{ds}) \tag{17}$$

Assuming that the primary currents $i_u$, $i_v$, $i_w$ immediately after the torque command signal T is altered from the power drive side to the brake side are represented as below for the simplification, $$\left.\begin{aligned} i_u &= \sqrt{2}\, I\sin\omega_o t \\ i_v &= \sqrt{2}\, I\sin(\omega_o t - \tfrac{2}{3}\pi) \\ i_w &= \sqrt{2}\, I\sin(\omega_o t + \tfrac{2}{3}\pi) \end{aligned}\right\} \tag{18}$$

the d-axis and q-axis primary currents $i_d$, $i_q$ become respectively as below $$\begin{bmatrix} i_d \\ i_q \end{bmatrix} = \sqrt{\frac{2}{3}} \begin{bmatrix} 1 & -\frac{1}{2} & -\frac{1}{2} \\ 0 & \frac{\sqrt{3}}{2} & -\frac{\sqrt{3}}{2} \end{bmatrix} \begin{bmatrix} i_u \\ i_v \\ i_w \end{bmatrix} = \sqrt{3}\, I \begin{bmatrix} \sin\omega t \\ -\cos\omega t \end{bmatrix} \tag{19}$$

When the differential equations of the equations (15) and (16) are solved under the conditions that the rotating angular velocity of the motor immediately after switching is constant, $\phi_{2d}$, $\phi_{2q}$ respectively become as represented by the following equations (20) and (21).

$$\phi_{2d} = K_1 [e^{-\frac{R2}{L2}t} \{K_2\cos\omega_2 t + K_3\sin\omega_2 t\} + K_4\cos\omega_o t + K_5\sin\omega_o t] + \phi_{2d}(0)\, e^{-\frac{R2}{L2}t} \cos\omega_2 t - \phi_{2d}(0)\, e^{-\frac{R2}{L2}t} \sin\omega_2 t \quad (20)$$

$$\phi_{2q} = K_1 [e^{-\frac{R2}{L2}t} \{K_3\cos\omega_2 t + K_2\sin\omega_2 t\} + K_5\cos\omega_o t + K_4\sin\omega_o t] + \phi_{2q}(0)\, e^{-\frac{R2}{L2}t} \cos\omega_2 t + \phi_{2d}(0)\, e^{-\frac{R2}{L2}t} \sin\omega_2 t \quad (21)$$

where $\omega_2$: $P\omega_r$ $K_1-K_5$: constants $\phi_{2d}(0)$: d-axis secondary magnetic flux immediately before switching $\phi_{2q}(0)$: q-axis secondary magnetic flux immediately before switching When the equations (20) and (21) are substituted in the equation (11), the torque T becomes as below.

$$T = K_6 + e^{-\frac{R2}{L2}t} [\{K_7 - K_8\phi_{2q}(0)\}\sin\omega_s t - \{K_9 - K_8\phi_{2d}(0)\}\cos\omega_s t] \quad (23)$$

where $K_6$-$K_9$: constants $\omega_S$: slip angle frequency $(=\omega_o - p\omega_r)$ As apparent from the equation (23), it is understood that the torque ripple of the frequency equal to the slip angle frequency $\omega_S$ is transiently generated at the torque generated in the motor.

The slip angle frequency $\omega_S$ at the time of braking is given by the equation (10). When the rotating speed of the motor at the time of full speed is, for example, 1800 r.p.m. in an elevator of 60 m/min. of speed, if the power drive is switched to the brake at the time of full speed, the absolute value of $\omega_S$ becomes as below in the motor of p=2.

$$\begin{aligned} |\omega_s| &= p\frac{R_2}{R_1+R_2}\omega_r \\ &= p\frac{R_2}{R_1+R_2}(30\times 2\pi) \\ &\approx 30\times 2\pi \text{ rad/sec}(\because R_1 \approx R_2) \end{aligned}$$

In other words, the motor generates a torque ripple of 30 Hz.

The transfer function of a machine system of an elevator, and particularly of a rope system is generally represented as shown in FIG. 6. More specifically, an ordinate axis indicates $\omega(=2\pi f)/T$ dB, and an abscissa axis indicates the frequency. It is understood from FIG. 6 that a gain is high in a range that the frequency f is low and low in a range that the frequency f is high. However, since the gain is not so low at the vibration of approx. 30 Hz, the vibration is transmitted into the cage, resulting in a reduced riding comfort.

SUMMARY OF THE INVENTION

The present invention has the objection of solving the above drawbacks and problems and provides an apparatus for controlling an A.C. powered elevator which can eliminate unpleasant vibration in an elevator cage at the time of switching from a power drive to a brake.

The apparatus for controlling an A.C. powered elevator according to the present invention is provided to reduce a primary current frequency to an induction motor to a value smaller than that indicated by the equation (7) at the time of switching from a power drive to a brake mode. In other words, the frequency after switching to the brake mode is reduced to be lower than the frequency at which the machine input power to the induction motor becomes equal to the internal power consumption of the induction motor.

In the A.C. powered elevator controller of the present invention, the frequency after switching to the brake mode is reduced lower than the frequency that the regenerative power is just consumed in the motor to a value that the slip frequency is set to a value which does not cause resonace to occur the machine system, thereby effectively suppressing the vibration in the cage.

BRIEF DESCRIPTION OF THE DRAWINGS

In the drawings, the same symbols indicate identical or corresponding portions.

DESCRIPTION OF THE PREFERRED EMBODIMENTS

Figure 1:
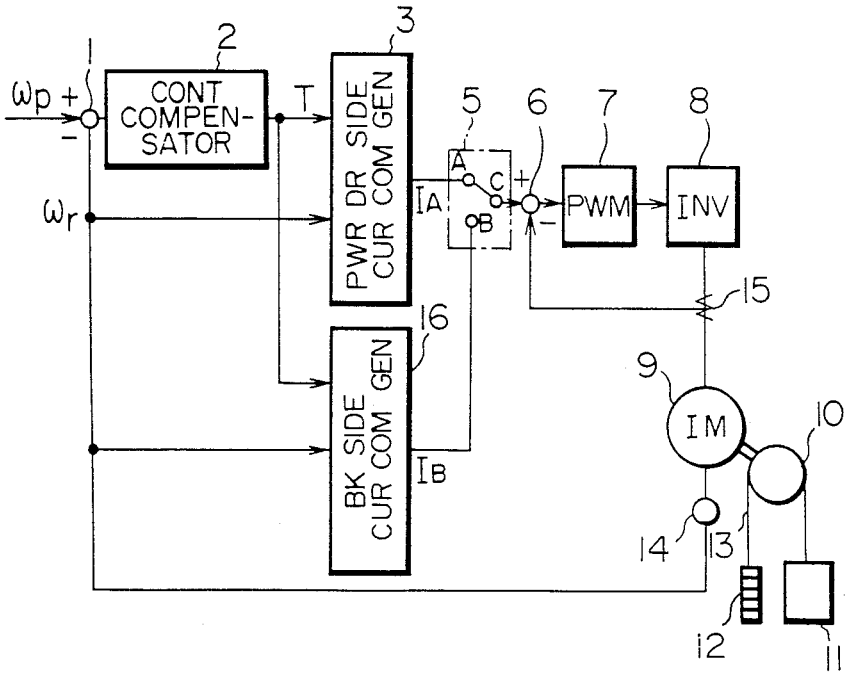
FIG. 1 is a circuit diagram showing an embodiment of an apparatus for controlling an A.C. powered elevator according to the present invention.
Figure 2:
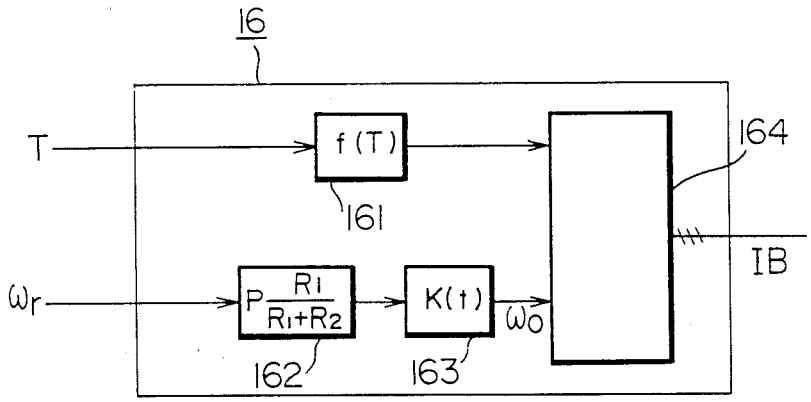
FIG. 2 is a view showing the detail of a brake side current command generator used in FIG. 1.
Figure 3:
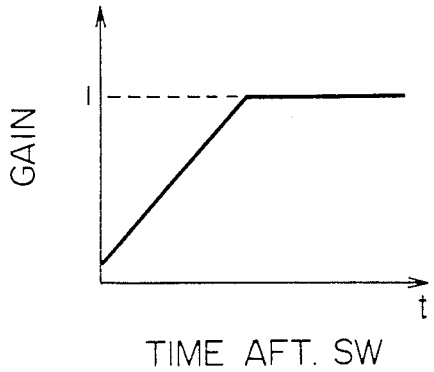
FIG. 3 is a view showing the characteristics of an amplifier used in FIG. 2.
Figure 4:
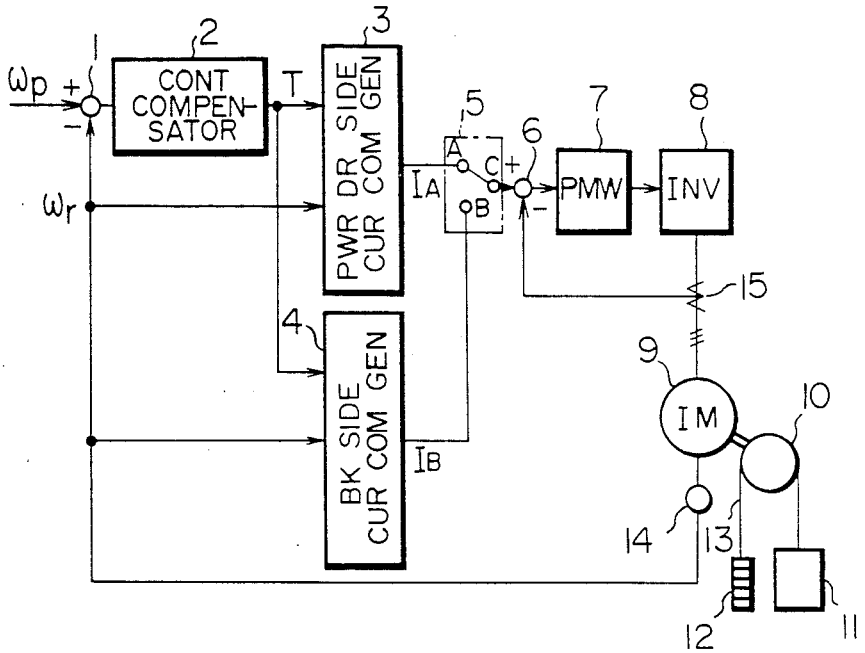
FIG. 4 PRIOR ART
FIG. 4 is a circuit diagram showing a conventional apparatus for controlling an A.C. powered elevator.
Figure 5:
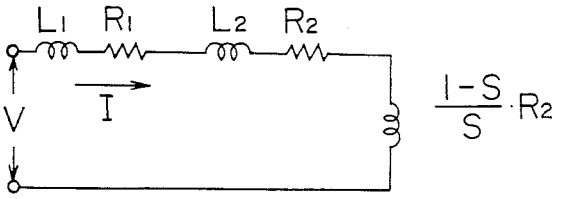
FIG. 5 is a simple equivalent circuit for explaining the operational principle of an induction motor.

FIG. 1 is a circuit diagram showing an embodiment of the present invention, which is different from FIG. 4 at the point of only a brake side current command generator 16, wherein reference numerals 1 to 3, 5 to 15 indicate the same parts as those in the conventional apparatus. FIG. 2 is a view showing the detail of a brake side current command generator 16 in FIG. 1. In the drawings, reference numeral 161 designates a function unit for generating a primary current amplitude command f(T) on the basis of a torque command signal T from a control compensator 2, numeral 162 an amplifier which inputs a gain of an actual speed signal $\omega_r$ from a tachometer generator 14, represented by $p\cdot R_1/R_1+R_2$, numeral 163 designates an amplifier which has a gain K(t) less than 1 immediately after being switched from the power drive to the brake and which approaches 1 as a function of time as shown in FIG. 3. Numeral 164 designates a sine wave generator which inputs a primary current amplitude command output from the function unit 161 and a primary current frequency command $\omega_o$ output from the amplifier 163, and generates since wave 3-phase current commands.

In the embodiment described above, the primary current frequency $\omega_o$ becomes as below.

$$\omega_o + p\frac{R_2}{R_1 + R_2} \cdot K(t)\omega_r \text{ (where } K(t) \leqq t) \tag{24}$$

At this time, the absolute value of the slip angle frequency $\omega_S$ is as below.

$$|\omega_o| + |\omega_o - p\omega_r| = \frac{R_1 + R_2\{1 - K(t)\}}{R_1 + R_2} p\omega_r \tag{25}$$

In FIG. 3, $\omega_S$ immediately after being switched from the power drive to the brake is larger than the value when K(t) is 1, and when K(0)=0 is satisfied, it becomes as below.

$$|\omega_s| = p\omega_r \tag{26}$$

Figure 6:
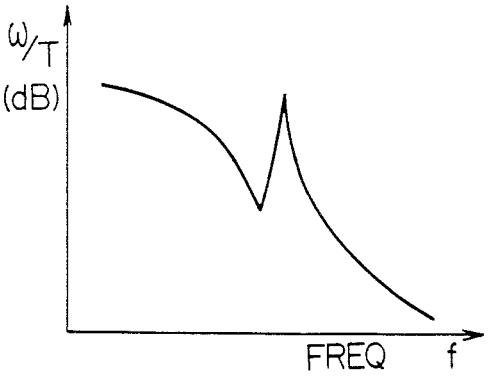
FIG. 6 is a view showing the transfer function of a machine system and particularly a rope system of an elevator.

As described with respect to FIG. 6, the gain of the machine system is small in a range that the frequency is high, the conventional example generates a torque ripple of 30 Hz, which vibration is transmitted to an elevator cage. On the other hand, according to the present invention, as represented by the equation (26), in case of K(0)=0, a torque ripple of 60 Hz is generated, but this is not transmitted as vibration into the elevator cage. As represented by the equation (24), if the condition of $K(t) \leqq 1$ is satisfied, the machine input of the induction motor is all consumed in the motor, but since excessive power is consumed in the motor in a range of $K(t) < 1$, it is not preferable due to the heat generation of the motor. More specifically, in case of K(t)=1, i.e., when $\omega_o = p \cdot R_1/R_1 + R_2 \cdot \omega_r$ is satisfied, the machine input of the motor becomes equal to the internal consumption of the motor (this state is called "a critical state", and when $\omega_o$ is larger than that, the internal power consumption in the motor becomes smaller than the machine input to regenerate power, while when ωo is smaller, the internal power consumption becomes contrarily larger to increase the heat generated from the motor. Therefore, it is preferable to set $K(t) < 1$ immediately after switching to the brake mode, and to return to K(t)=1 as time is elapsed. Since the torque ripple of the motor by the exponential function term of $e^{-R_2/L_2 \cdot t}$ is reduced as represented by the equation (23), there is no possibility that the vibration is transmitted into the elevator cage.

According to the present invention as described above, the primary current frequency to the induction motor after being switched from the power drive to the brake mode is further reduced from the critical frequency so that no regenerative power is generated from the induction motor. Therefore, an unpleasant vibration is not transmitted to the elevator cage.

What is claimed is:

1. An apparatus for controlling an A.C. powered elevator in which an inverter is connected to a D.C. power source to convert a D.C. power into an A.C. power to drive an induction motor by the A.C. power to thereby operate the elevator comprising a brake side current command generator for generating a current command having a frequency lower than a critical frequency so that no regenerative power is generated from said induction motor when said induction motor is switched from a power drive to a brake mode.

2. An apparatus for controlling an A.C. powered elevator according to claim 1, wherein the frequency of a current command value by said brake side current command generator is returned to the critical frequency as time elapses after being switched to the brake mode.

* * * * *